US005538454A

United States Patent [19]

Kessler

[11] Patent Number: 5,538,454

[45] Date of Patent: Jul. 23, 1996

[54] DECORATION OF CHILDREN'S PLAYTHINGS INCLUDING AN EXERCIZE AND ENTERTAINMENT HOOP

[75] Inventor: Brian D. Kessler, Youngstown, Ohio

[73] Assignee: Maui Toys, Inc., Youngstown, Ohio

[21] Appl. No.: 175,668

[22] Filed: Dec. 30, 1993

Related U.S. Application Data

[63] Continuation of Ser. No. 909,854, Jul. 7, 1992, abandoned, which is a continuation-in-part of Ser. No. 879,375, May 7, 1992, abandoned.

[51] Int. Cl.[6] ..... A63H 33/22; A63H 33/02

[52] U.S. Cl. ..... 446/236; 446/28; 446/369; 273/425; 273/336

[58] Field of Search ..... 273/336, 339, 273/424, 425; 446/28, 236, 450, 369; 482/148

[56] References Cited

U.S. PATENT DOCUMENTS

| | | | |
|---|---|---|---|
| 2,684,497 | 7/1954 | Graham | 401/197 |
| 3,079,728 | 3/1963 | Melin | 446/236 |
| 3,109,651 | 11/1963 | Wheeler . | |
| 3,911,264 | 10/1975 | Chao . | |
| 3,918,708 | 12/1975 | Augusta . | |
| 4,052,982 | 10/1977 | Ozeryansky . | |
| 4,215,510 | 8/1980 | Worrell . | |
| 4,241,533 | 12/1980 | Newsome | 446/46 |
| 4,380,885 | 4/1983 | Komagata . | |
| 4,898,392 | 2/1990 | Goletz | 273/336 |
| 4,915,666 | 4/1990 | Maleyko . | |
| 4,944,707 | 7/1990 | Silverglate | 446/48 |
| 5,078,637 | 1/1992 | McFarland | 446/48 X |
| 5,120,261 | 6/1992 | Dietzman | 482/83 X |
| 5,356,132 | 10/1994 | McEwan et al. | 273/336 X |

FOREIGN PATENT DOCUMENTS

| | | | |
|---|---|---|---|
| 3242360 | 5/1984 | Germany | 446/370 |
| 200817 | 7/1923 | United Kingdom | 273/425 |

*Primary Examiner*—Danton D. DeMille
*Attorney, Agent, or Firm*—Browdy and Neimark

[57] ABSTRACT

Playthings, such as exercise and entertainment hoops, children's bats, batons and jump ropes, are provided with an elongated sheath of fabric tightly adhering thereto, the fabric sheath being available in a variety of decorative patterns at a low cost. This enables the base product to be mass produced in an inexpensive way in accordance with conventional practice, but then to provide such products with individualized appearance with the fabric covering.

3 Claims, 2 Drawing Sheets

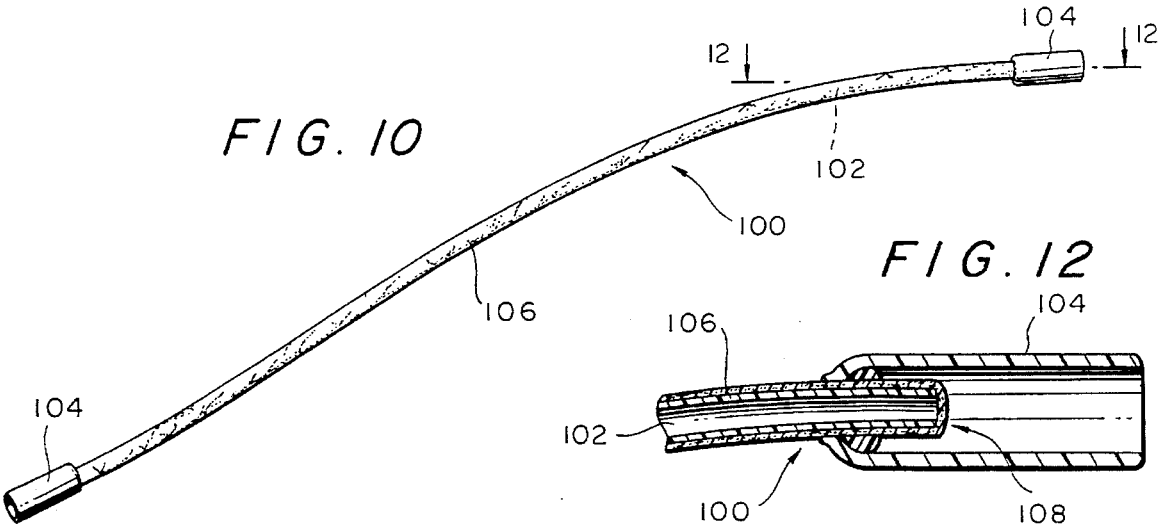
FIG. 10
FIG. 12
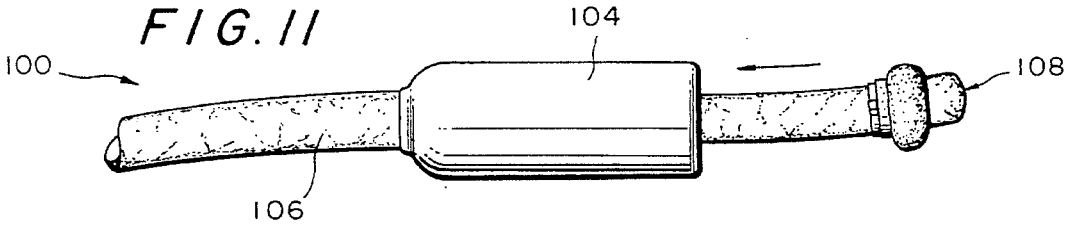
FIG. 11
FIG. 13
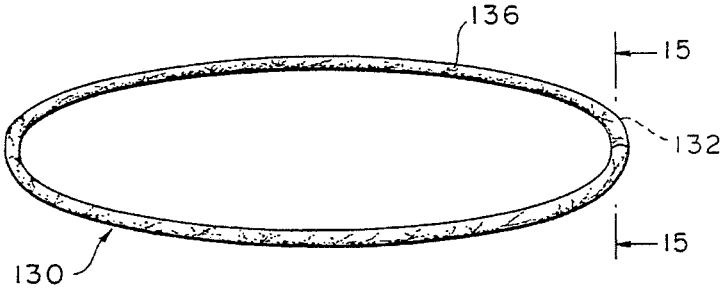
FIG. 14
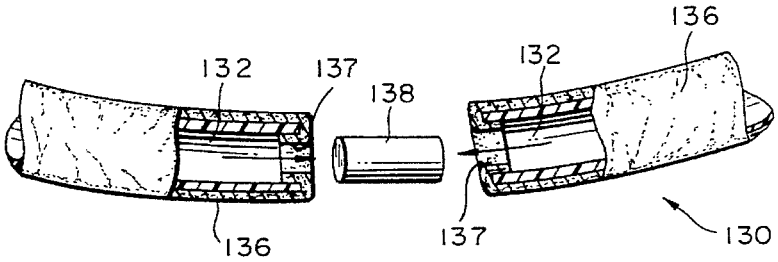
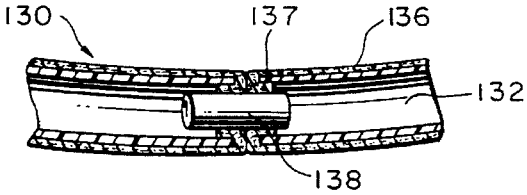
FIG. 15

DECORATION OF CHILDREN'S PLAYTHINGS INCLUDING AN EXERCIZE AND ENTERTAINMENT HOOP

This application is a continuation of application Ser. No. 07/909,854, filed Jul. 7, 1992, now abandoned which is a continuation-in-part of application Ser. No. 07/879,375, filed May 7, 1992, now abandoned.

FIELD OF THE INVENTION

The present invention relates to improvements in the decoration of children's playthings and, more particularly, an improved method of providing children's playthings with an easily variable decorative appearance so that mass produced children's playthings can be easily and inexpensively varied so that they do not all look alike. The invention also relates to the resultant playthings.

BACKGROUND

Children's playthings, such as exercise and entertainment hoops, children's bats, batons and jump ropes, and other devices of the same general character, are readily available in the marketplace at a low price, these playthings being mass produced in large quantities at low cost. One of the problems with the playthings of this type is that they look cheap. Of course, it is possible to improve the appearance of these articles by special surface applications after their initial manufacture, but this increases the costs substantially. Moreover, such special treatments, such as special coating operations, must be individualized if the mass produced devices are to be given an appearance which differs from one to another, and this requires individual, manual attention and very greatly increases the costs of these devices.

SUMMARY OF THE INVENTION

It is, accordingly, an object of the invention to overcome deficiencies in the prior art, such as those indicated above.

It is another object of the present invention to provide improvements in the decoration of playthings, especially children's playthings.

It is a further object of the present invention to provide a method for easily and inexpensively providing surface decoration to playthings which provides considerable variation in the appearance of such playthings from one to another.

It is still another object of the present invention to provide various types of playthings having a variable appearance from one to another, and yet which are still of very low cost.

It is yet a further object of the present invention to provide such playthings which, in many cases, have improved functional properties as a result of the type of variable decoration provided.

These and other objects are achieved according to the present invention by covering the playthings with stretch fabric in the form of a sock-like material. Such sock-like covers may be inexpensively woven or knitted in a wide variety of patterns, and may be slipped over each plaything so that a wide variety of patterns may be provided on playthings which are otherwise mass produced in a single form.

BRIEF DESCRIPTION OF DRAWING

The above and other objects and the nature and advantages of the present invention will be more apparent from the following detailed description of certain embodiments, taken in conjunction with the drawing, wherein:

FIG. 10 is a plan view of a jump rope in accordance with the present invention;

FIG. 11 is a detail showing one end of the jump rope of FIG. 10;

FIG. 12 is a sectional view taken along line 12—12 of FIG. 10;

FIG. 13 is a perspective view of an exercise and entertainment hoop in accordance with the present invention;

FIG. 14 is a detail view showing assembly of the hoop of FIG. 13; and

FIG. 15 is a sectional view taken along line 15—15 of FIG. 13.

DETAILED DESCRIPTION OF EMBODIMENTS

Figure 1:
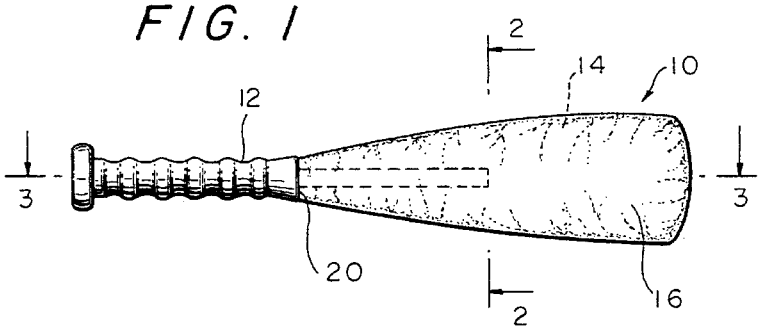
FIG. 1 is a plan view of a so-called "soft" bat in accordance with the present invention.

FIG. 1 shows what is known as a soft bat 10 intended for very young children. As is conventional, it has a hollow plastic handle 12 to which is attached in a suitable and known manner a soft foam (e.g. polyurethane rubber) "hitting" portion 14 of larger than normal diameter. All this is conventional.

In accordance with the present invention, there is provided a sock-like fabric covering 16 which covers the entire "hitting" portion 14. The fabric "sock" 16 is desirably closed at the free end 18 and is tucked-in and sealed in a suitable manner such as by the use of adhesive, or even mechanical means such as staples or thread, at the juncture 20 between the handle 12 and the hitting portion 14.

It is a key aspect of the present invention that the "sock" 16 can be simply, easily and inexpensively woven or knitted in a wide variety of patterns and colors, and thereby provides the bat 10 with a very wide range of appearances in an exceedingly inexpensive manner. The sock 16 is of course woven or knitted in the approximately correct size and is then stretched to fit tightly and snugly over the foam core 14 so as to conform to the configuration of the core 14.

While the main advantage is, as pointed out above, the provision of an easily and inexpensively changed decorative pattern so that all the soft bats 10 do not have the same appearance, there are secondary advantages as well. Thus, the foam core 14 is protected and is not so easily subjected to shredding and tearing. In addition, the fabric 16 provides a certain degree of roughness, and thereby makes good contact between the bat 10 and any ball hit by it.

Figure 2:
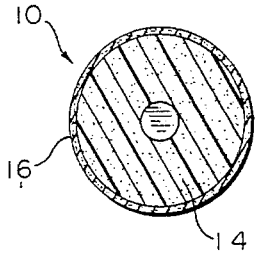
FIG. 2 is a sectional view taken along line 2—2 of FIG. 1.
Figure 3:
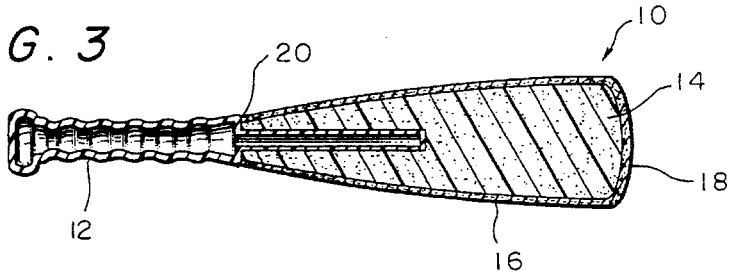
FIG. 3 is a sectional view taken along line 3—3 of FIG. 1.
Figure 4:
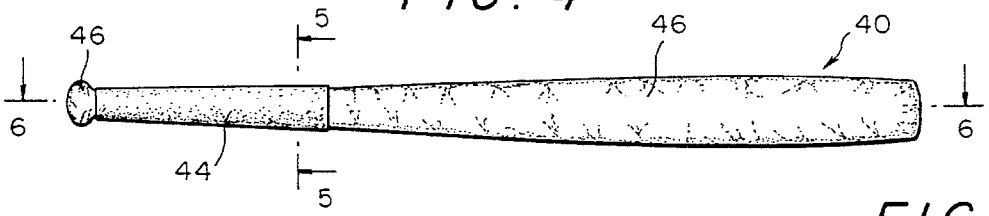
FIG. 4 is a plan view of a so-called "wiffle ball" bat in accordance with the present invention.
Figure 6:
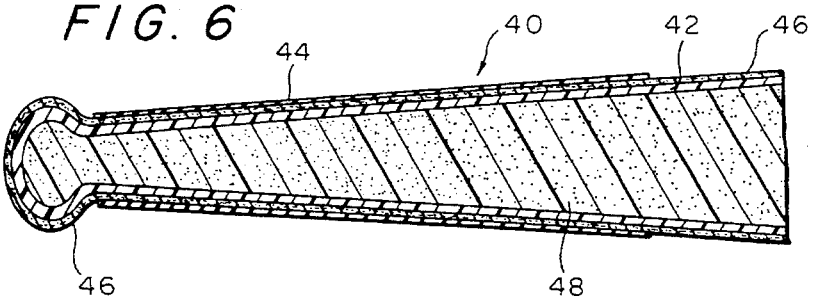
FIG. 6 is a partially broken away sectional view taken along line 6—6 of FIG. 4.
Figure 5:
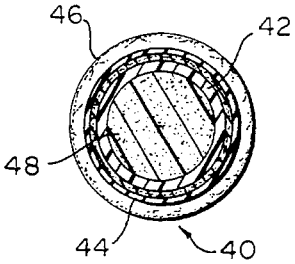
FIG. 5 is a sectional view taken along line 5—5 of FIG. 4.

FIGS. 4–6 show another embodiment of a bat, also inexpensively formed of plastic, intended for use by a child somewhat older than the child who would use the soft bat of FIGS. 1–3. The bat 40 of FIGS. 4–6 comprises a generally unitary hollow shell 42 formed of relatively rigid plastic, such as a polyolefin or PVC or the like. The shell 42 in turn is provided with a gripping sheath 44 which defines the handle portion, the sheath being formed of an elastomer, e.g. rubber or an elastomeric plastic, as is conventional.

In accordance with the present invention, the hollow shell 42 may desirably be filled with a flexible or rigid foam 48 for structural support, density and weight. The bat 40 is covered with a fabric stretch sock 46 of the character of the sock 16 described above, the sock 46 being slipped over the plastic shell 42 and stretched to conform to the exterior of the shell 42, and then being closed at one end, e.g. the handle end, such as by sewing to fix it to teh bat 40. The handle sheath 44 is then applied over the stretch fabric sock 46.

Figure 7:
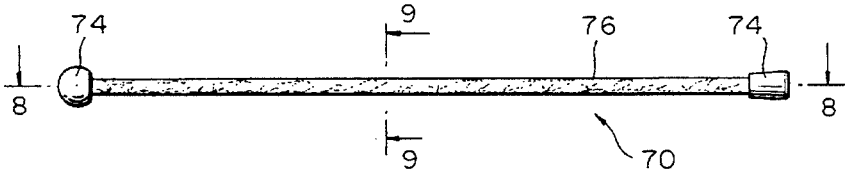
FIG. 7 is a plan view of a baton in accordance with the present invention.
Figure 8:
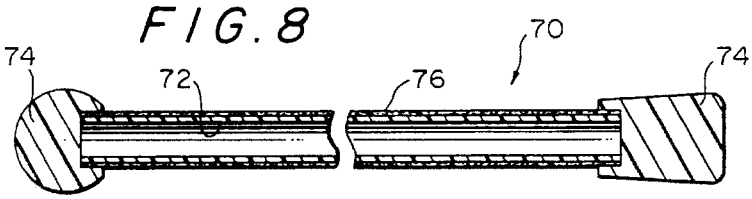
FIGS. 8 and 9 are respective sectional views taken along lines 8—8 and 9—9 of FIG. 7.
Figure 9:
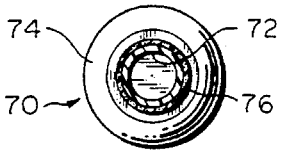

The baton 70 of FIGS. 7–9 is formed of a rigid cylinder 72, such as one formed of PVC or acrylic plastic or the like, and has two end caps 74 as is conventional. In accordance with the present invention, either a cylindrical sheath of decorative fabric 76 open at both ends or a similar sock closed at one end is stretched tightly over the rigid cylinder 72 with one or both ends being tucked within the cylinder 72, after which the end caps 74 are applied to frictionally hold the decorative stretch fabric cover 76 in place.

FIGS. 10–12 show a jump rope 100 with a "rope" section 102, here shown in the form of a flexible plastic tube, and handles 104 at both ends thereof, as is conventional. In accordance with the present invention, the rope portion 102 is covered with a tube or sheath 106 of stretch fabric of the same character as those described above. After being applied over the rope portion 102, the stretch fabric tube 106 is stretched tight to conform to the exterior of the "rope" 102, and is sealed at the ends 108.

FIGS. 13–15 show an exercise and entertainment hoop 130. The hoop 130 is formed of a semi-rigid plastic such as a polyolefin as is well known. Such hoops are conventionally made by bending plastic tubing 132 into a circular form and then bringing the two free ends together and closing same by suitable means well known in the art.

In accordance with the present invention, a sock or tube 136 is placed over the bent tube 132 before its ends are joined, and the fabric sheath 136 is stretched tight and its free ends 137 are tucked into the open ends of the tube 132. A plug 138, such as one formed of wood or plastic or rubber, is then forced into the two open ends of the tube 132 so as to frictionally hold together the two ends of the tube 132 as well as to fix the decorative, stretched fabric sheath 136. To insure tightness of the joint, staples may be applied from the outside.

The decorative stretch fabric sheath not only has its main function as described above, namely the provision of a great variety of patterns at a very low cost so as to be able to provide a plaything 130 which is still inexpensive but which is variable in appearance, but the roughness of the fabric also improves the ease with which the hoop 130 can be rotated about the user's body, the fabric providing an enhanced degree of friction between the hoop and the clothing of the user.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In an exercise and entertainment hoop in the form of a circle adapted to extend about the torso of a person and to be rotated about the torso of a person without the use of hands, the improvement wherein said hoop consists of a single rigid plastic tube joined end-to-end, said tube being entirely covered and encircled with a tubular sheath of elastic stretch fabric having a decorative pattern, said sheath of stretch fabric having opposite sheath ends being unstitched to one another and being stretched tightly over to conform to the entire circular cross-sectional configuration of said tube and being fixed thereto, whereby said sheath ends may be assembled around the tube and held onto the hoop when the tube is assembled end-to-end so that the hoop may display any one of a plurality of decorative patterns.

2. An exercise and entertainment hoop in the form of a circle for rotating the hoop about the torso of a person without the use of hands, said hoop consisting of:

a one-piece rigid plastic tube, the tube being joined end-to-end and being entirely covered and encircled with;

a tubular sheath of stretch fabric having a decorative pattern, said sheath of stretch fabric tightly conforming to the entire circular cross-sectional configuration of said tube and being fixed thereto; and means for joining the end-to-end, said sheath of stretch fabric having opposite sheath ends held by said means for joining the tube end-to-end;

whereby said sheath ends may be assembled around the tube and held onto the hoop when the tube is assembled end-to-end so that the hoop may display any one of a plurality of stretch fabrics having decorative patterns.

3. A plaything in accordance with claim 2 wherein said sheath of stretch fabric has an end which is tucked into and retained within an end of said plastic tube.

* * * * *